US006887568B2

(12) United States Patent
Guevel et al.

(10) Patent No.: US 6,887,568 B2
(45) Date of Patent: May 3, 2005

(54) REINFORCED THERMALLY STABLE HYBRID YARN

(75) Inventors: Jean Guevel, Lyons (FR); Guy Bontemps, Tenay (FR)

(73) Assignee: SA Schappe, Ban de Laveline (FR)

( * ) Notice: Subject to any disclaimer, the term of this patent is extended or adjusted under 35 U.S.C. 154(b) by 0 days.

(21) Appl. No.: 10/466,246

(22) PCT Filed: Feb. 15, 2002

(86) PCT No.: PCT/FR02/00595

§ 371 (c)(1),
(2), (4) Date: Jul. 15, 2003

(87) PCT Pub. No.: WO02/066719

PCT Pub. Date: Aug. 29, 2002

(65) Prior Publication Data

US 2004/0053048 A1 Mar. 18, 2004

(30) Foreign Application Priority Data

Feb. 16, 2001 (FR) ..... 01 02187

(51) Int. Cl.[7] ..... D02G 3/00; D02G 3/36; D02G 3/02

(52) U.S. Cl. ..... 428/370; 428/377; 57/210; 57/224

(58) Field of Search ..... 428/370, 377; 57/210, 224

(56) References Cited

U.S. PATENT DOCUMENTS 4,840,021 A * 6/1989 Guevel et al. ..... 57/210
6,410,140 B1 * 6/2002 Land et al. ..... 428/377

FOREIGN PATENT DOCUMENTS

| | | |
|---|---|---|
| DE | 44 33 710 A1 | 3/1995 |
| EP | 0 271 418 A1 | 6/1988 |
| FR | 2 611 749 | 9/1988 |

* cited by examiner

*Primary Examiner*—N. Edwards
(74) *Attorney, Agent, or Firm*—Oliff & Berridge, PLC

(57) ABSTRACT

The inventive yarn comprises at least one strand (2) having a reinforcing core made of high-modulus and high-resistance staple-fiber yarn, which is made from organic or inorganic material, and a sheath (4) of long or short, low-modulus standard fibers. The other strands (5) are made from long or short, low-modulus standard fibers and are arranged so as to protect the sheath of the strand(s) having a reinforcing core.

10 Claims, 1 Drawing Sheet

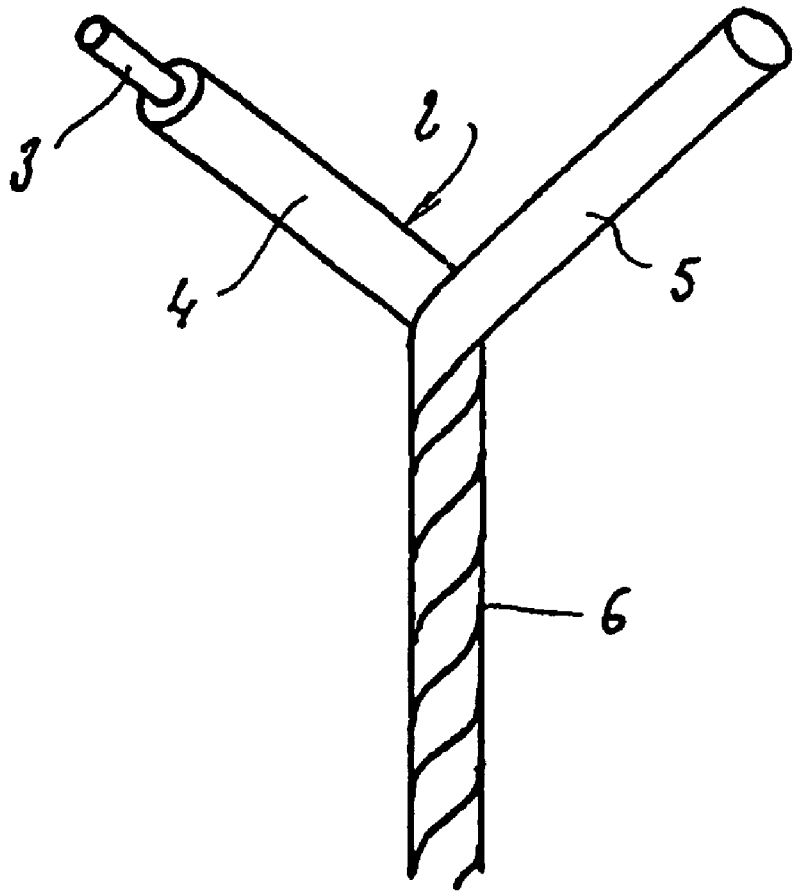
3
2
4
5
6

REINFORCED THERMALLY STABLE HYBRID YARN

The subject of the present invention is a reinforced thermally stable hybrid yarn.

Spun yarns of fibers, reinforced by a coaxial core, that are known from European patent No. 0 271 418, are obtained on modified spinning machines. The cores of these spun yarns are produced from high-strength high-modulus organic fibers belonging to the family of PPTA (polyparaphenylene terephthalamide) polymers, or other synthetic fibers having high mechanical properties (high strength, high modulus). There are many applications of these spun yarns in the field of the production of fabrics designed for the personal protection of those people moving in various sectors, such as civil protection, exposed sectors in industry, certain military clothing, but also in civil fields, such as sport and recreation.

The fundamental characteristics that fabrics intended for the protection of people exposed to environmental risks must have are recalled below. This table 1 endeavors to be exhaustive so as to cover all the above situations.

TABLE 1

| | Qualitative performance required of the fabric | | | | | | |
|---|---|---|---|---|---|---|---|
| Risk | Thermal stability | Thermal insulation convective conductive | | Radiative thermal insulation | Tensile strength | Tear strength | Performance durability |
| Flames | 6 | 6 | 6 | 6 | 3 | 3 | 6 |
| Convective heat | 6 | 6 | 6 | 3 | 3 | 3 | 6 |
| Radiative heat | 6 | 6 | 6 | 6 | 3 | 3 | 6 |
| Heat flash | 6 | 6 | 6 | 6 | 3 | 3 | 6 |
| Molten metal splashing | 6 | 6 | 6 | 3 | 3 | 3 | 6 |
| Chemical risk | 3 | 3 | 3 | 3 | 6 | 6 | 6 |
| Mechanical risk | 3 | 3 | 3 | 3 | 6 | 6 | 6 |

The classification scale from 1 to 6 is interpreted in the following manner:

The number 1 corresponds to low requirements, these increasing continuously up to the number 6, which corresponds to very high requirements as regards the criterion in question, and meeting most of the standards in force.

Table 2 gives the characteristics of a fabric obtained from a spun yarn produced according to the aforementioned patent from the following materials:

cored spun yarns produced from a PPTA fiber with the following properties:

Tenacity: 24 cN/dtex (cN=centinewton)

Modulus: >45 GPa, i.e. 290 cN/dtex

Unit titer: >0.8 dtex

Elongation at break: 3.5 to 5%;

cover fibers used: meta-aramid or polyamideimide with the properties:

Tenacity: 3 to 4 cN/dtex

Modulus: 50 to 60 cN/dtex

Titer: 1.5 to 2.5 dtex.

TABLE 2

| | Qualitative performance provided by the fabric | | | | | | |
|---|---|---|---|---|---|---|---|
| Risk | Thermal stability | Thermal insulation convective conductive | | Radiative thermal insulation | Tensile strength | Tear strength | Performance durability |
| Flames | 6 | 6 | 6 | 6 | 6 | 6 | 6 |
| convective heat | 6 | 6 | 6 | 6 | 6 | 6 | 6 |
| Radiative heat | 6 | 6 | 6 | 6 | 6 | 6 | 6 |
| Heat flash | 6 | 6 | 6 | 6 | 6 | 6 | 6 |
| Molten metal splashing | 6 | 6 | 6 | 6 | 6 | 6 | 6 |
| Chemical risk | 6 | 6 | 6 | 6 | 6 | 6 | 6 |
| Risk | 6 | 6 | 6 | 6 | 6 | 6 | 6 |

It should be noted that the maximum rating of 6 is found for all the criteria adopted. By comparing the above table with the first one, it may be seen that the product is greatly overdesigned as regards the requirements. This is not without impact on the cost of the product, which is thus penalized by a superfluity of properties.

Experience has shown in general that the performance levels required in table 1 are achieved when the concentration of high-strength high-modulus fiber spun yarn is greater than 23% of the total of the spun yarn by weight.

According to the prior art, illustrated by the performance table 2, it is very difficult to produce spun yarns containing only 23% of core yarns. This is because for an overall spun yarn of Nm 45/2, the core spun yarn would have to have a titer of 45/0.23≈196 Nm. Above all, it is the economics that make this impossible. To produce such a spun yarn, even in the proportion of 23% by weight, would make the product commercially uncompetitive. On analyzing all these factors, we were forced to consider a new approach allowing us to meet the performance criteria set out in table 1 more closely.

The spun yarns used to produce the fabrics corresponding to the criteria in table 1 are always spun yarns comprising two elementary spun yarns or strands, for example Nm 36/2, 40/2, 45/2, 50/2, etc.

The object of the invention is to provide a reinforced thermally stable hybrid yarn in which the reinforcing elements can be present in a lower amount than in the yarns known previously, thus allowing the concentration of reinforcing fibers to be metered according to the application and to meet essential economic requirements, while still allowing conventional manufacture of this yarn.

BRIEF DESCRIPTION OF THE DRAWINGS

For this purpose, the yarn to which the invention relates comprises at least one strand produced with a reinforcing core made of a high-modulus high-strength fiber spun yarn based on an organic or inorganic material and a cover made of conventional, long or short, low-modulus fibers, the other strands being made of conventional, long or short, low-modulus fibers, these other strands being designed to protect the cover of the one or more strands with a reinforcing core.

It should be noted that with such a concentration of the core in the individual strand containing it, the cover part of the fiber spun yarn forming the core is highly diluted and consequently very susceptible to abrasion. The combining of strands containing a reinforcing core with strands produced with a conventional technique, such as the spinning of long or short fibers, allows the strand or strands containing the reinforcing fiber to be protected, by mutual and partial covering of this strand or these strands by the other strands.

According to one possibility, this yarn is formed by a twist yarn in which the various strands are assembled by twisting. In such a case, the constituent turns of the strands made of conventional fiber partially cover the turns produced from the strand or strands that include the reinforcing core, thus improving the abrasion resistance.

Furthermore, these other strands protect the fibers of the core spun yarn from the action of ultraviolet radiation and also makes it possible to confine the fibrillation of the high-modulus high-strength materials inside a spun yarn, thereby allowing the correct appearance properties of the final fabric to be maintained even after many washing operations or after intensive use.

According to one embodiment of this yarn, the latter comprises two strands, one of which has a reinforcing core and the other of which comprises conventional, long or short, low-modulus fibers.

Advantageously, the concentration by weight of the core spun yarn relative to the total weight of the yarn is between 23 and 35%.

The reinforcing core spun yarn has a natural tendency to possess a residual torque that unbalances the hybrid yarn. The conventional yarns forming the other fraction of the hybrid yarn are formed completely from low-modulus low-strength fibers. These fibers consequently do not possess a residual torque capable of balancing the hybrid yarn. To achieve this balance, it is necessary to maintain a difference between the individual twists of the spun yarns making up the hybrid yarn. For this purpose, the hybrid yarn satisfies a twist balancing condition according to the formula:

$$0.85\alpha\sqrt{T_t} \leqq \alpha K_{ac} \leqq 0.9\alpha\sqrt{T_t}$$

in which:

$K_{ac}$=twist of the strand with a reinforcing core (t/m);

$T_t$=titer of the conventional strand (Nm);

$\alpha$=twist coefficient with $80 \leqq \alpha \leqq 110$.

According to one feature of the invention, the fibers used to produce the reinforcing core have a modulus of greater than 40 GPa and a tensile strength of greater than 13 cN/dtex.

7. According to one possibility, the fibers used to produce the reinforcing core are chosen from polyparaphenylene terephthalamide (PPTA), polybenzydizoxazole (PBO) and high-molecular-weight polyethylene (PE).

According to a first embodiment, the low-modulus fibers used for the cover of the reinforcing core and for producing the one or more strands are chosen from meta-aramids and polyamideimides.

According to another embodiment, the low-modulus fibers used for the cover of the reinforcing core and for producing the one or more strands are formed from mass-fire-retarded polymeric fibers.

According to yet another embodiment, the low-modulus fibers used for the cover of the reinforcing core and for producing the one or more strands are formed from plant-based fibers fire-retarded or otherwise.

It should be noted that it is possible to combine various types of fibers, for example plant-based fibers, such as cotton fibers, and mass-fire-retarded polymeric fibers.

To improve the properties of the fabric that will be obtained using this yarn, one of its components contains a fraction of conducting or electrostatic-charge-dissipating fibers.

By analyzing a 2-strand twist spun yarn, it is possible to imagine a construction of the following type, shown in the single FIGURE of the appended schematic drawing:

- a first strand 2 produced with a high-strength high-modulus fiber spun yarn core 3 and a cover 4 made with a thermally stable fiber;
- a second spun yarn produced without a core, and therefore conventional, consisting of long or short fibers, made of 100% thermally stable fibers.

To achieve a concentration of greater than 23%, all that will be required is to produce the core spun yarn by satisfying the condition:

$$\frac{T}{2Ta} > 0.23 \tag{1}$$

Tt=total titer of the spun yarn

Ta=titer of the core spun yarn

The titer of the core spun yarn is given by (1):

$$Ta < \frac{Tt}{2 \times 0.23} \tag{2}$$

A first specific example, that does not limit the scope of the invention, will make the construction of the final spun yarn more clearly understood.

The aim is to obtain a thermally stable fabric corresponding to the requirements of table (1) based on a weight per unit area of 210 to 215 g/m$^2$.

To obtain a sufficiently structured fabric, the titer Tt must be:

$$Tt = 45 \text{ Nm.}$$

Study of the First Constituent Strand 2 of the Twist Yarn:

The titer of the core spun yarn is in this case:

$$Ta < \frac{45}{2 \times 0.23} = 97.8\ Nm \tag{3}$$

It consists 100% of high-strength high-modulus fibers. For safety, we will adopt Nm 90, verifying condition (2). In this case, the concentration of the core spun yarn in the 1st strand is:

$$C_1 = \frac{Tt}{Ta} = \frac{45}{90} = 0.5 \quad (4)$$

The cover fibers of this first core spun yarn are formed from "short" or "long" thermally stable fibers, giving a final result of $$Tt=0.5.\ Ta=0.5\times 90=45\ \text{Nm} \quad (5)$$

Study of the Second Constituent Strand 5 of the Twist Yarn:

This spun yarn is a conventional spun yarn obtained either from long or short fibers containing 100% thermally stable fibers of the same type as the fiber used for covering the core spun yarn of the first strand.

The yarn 6 thus formed may, schematically, be as follows:

Ta: titer of the 100% high-strength high-modulus fiber core spun yarn

Tc: titer of the cover of short or long, thermally stable fibers

Tt: titer of the second strand formed by Nm45, short or long, thermally stable fibers T: titer of the twist yarn.

The final titer of the overall spun yarn is thus:

$$\frac{1}{T} = \frac{1}{Ta} + \frac{1}{Tc} + \frac{1}{Tt} \quad (6)$$

i.e. in the case described:

$$T = \frac{TaTcTt}{TcTt + TaTt + TaTc}$$

$T$=22.5 Nm, i.e. 45/2 Nm.

The composition of this spun yarn is therefore:

high-strength high-modulus fibers: 25% thermally stable fibers: 75%

A second nonlimiting example of a yarn according to the invention is described below:

to be produced is a fire-resistant, dimensionally stable fabric designed to be used in the aluminum metallurgy industry. This fabric must have a weight of 250 g/m$^2$. The presence of a high-strength high-modulus core spun yarn is essential for two reasons:

stability of the fabric to washing at high temperature >100°:

R<2%;

to obtain a weight of 250 g/m$^2$, the titer must be:

Tt=36 Nm.

Study of the First Constituent Strand of the Twist Yarn

The titer of the core spun yarn is in this case:

$$Ta < \frac{36}{2\times 0.23} = 78.3\ Nm \quad (9)$$

For safety, Nm 72 is adopted, verifying the condition (9). In this case, the concentration of the core spun yarn in the first strand is:

$$C1 = \frac{Tt}{Ta} = \frac{36}{72} = 0.5 \quad (10)$$

It is formed from 100% high-strength high-modulus fibers. The cover fibers of this first core spun yarn are formed 50% from PVA (polyvinyl alcohol) fibers and 50% from cotton fibers, which give a result of:

$$Tt=72\times 0.5=36\ \text{Nm} \quad (11)$$

Study of the Second Constituent Strand of the Twist Yarn

The spun yarn is a conventional spun yarn, obtained by mixing 50% PVA fibers and 50% cotton fibers by weight, produced using cotton technology.

With Ta, Tc, Tt and T defined as above, the final titer of the overall spun yarn is thus:

$$T = \frac{TaTcTt}{TcTt + TaTt + TaTc}$$

$T$=18 Nm, i.e. 36/2 Nm.

The composition of the spun yarn is therefore:

high-strength high-modulus fibers: 25%

FR-PVA+cotton fibers: 75%

The technology described above makes it possible to obtain spun fibers, and therefore fabrics, whose performance may a priori be apportioned, something which is not possible with the prior art in which the constituent spun yarns all have the same composition, with no technico-economic possibility of achieving the low-concentrations of high-strength high-modulus spun yarns.

It should be noted that one of the advantages of this technology is that the fibers of the core spun yarns are shielded from the action of UV that is very prejudicial in the case of PPTA or PBO fibers, and hence all fibers containing amide and aromatic groups.

This system also makes it possible to confine the fibrillation of the high-modulus high-strength materials within one of the constituent spun yarns of the complete yarn, and thus allows the correct appearance properties to be maintained even after very many washing operations or after intensive use.

What is claimed is:

1. A thermally stable hybrid yarn, comprising at least one strand produced with a reinforcing core made of a high-modulus high-strength fiber spun yarn based on an organic or inorganic material and a cover made of conventional, long or short, low-modulus fibers, the other strands being made of conventional, long or short, low-modulus fibers, these other strands being designed to protect the cover of the one or more strands with a reinforcing core, wherein the hybrid yarn satisfies a twist balancing condition according to the formula:

$$0.85\alpha\ T_t<\alpha K_{ac}<0.9\alpha\ T_t$$

in which:

$K_{ac}$=twist of the strand with a reinforcing core (t/m);

$T_t$=titer of the conventional strand (Nm);

$\alpha$=twist coefficient with $80<\alpha<110$.

2. The hybrid yarn as claimed in claim 1, wherein it is in the form of a twist yarn in which the various strands are assembled by twisting.

3. The hybrid yarn as claimed in claim 2, comprising two strands, one of which has a reinforcing core and the other of which comprises conventional, long or short, low-modulus fibers.

4. The hybrid yarn as claimed in claim 1, wherein the concentration by weight of the strand produced with the reinforcing core relative to the total weight of the hybrid yarn is between 23 and 35%.

5. The hybrid yarn as claimed in claim 1, wherein the fibers used to produce the reinforcing core have a modulus of greater than 40 GPa and a tensile strength of greater than 13 cN/dtex.

6. The hybrid yarn as claimed in claim 1, wherein the fibers used to produce the reinforcing core are chosen from polyparaphenylene terephthalamide (PPTA), polybenzydizoxazole (PBO) and high-molecular-weight polyethylene (PE).

7. The hybrid yarn as claimed in claim 1, wherein the low-modulus fibers used for the cover of the reinforcing core and for producing the one or more strands are chosen from meta-aramids and polyamideimides.

8. The hybrid yarn as claimed in claim 1, wherein the low-modulus fibers used for the cover of the reinforcing core and for producing the one or more strands are formed from mass-fire-retarded polymeric fibers.

9. The hybrid yarn as claimed in claim 1, wherein the low-modulus fibers used for the cover of the reinforcing core and for producing the one or more strands are formed from plant-based fibers fire-retarded or otherwise.

10. The hybrid yarn as claimed in claim 1, wherein one strand contains a fraction of conducting or electrostatic-charge-dissipating fibers.

* * * * *